United States Patent [19]

Wilbs

[11] 4,160,475

[45] Jul. 10, 1979

[54] WARM WATER HEATER

[76] Inventor: Thomas Wilbs, Wiesenstr. 5, Wutoschingen, Fed. Rep. of Germany

[21] Appl. No.: 812,591

[22] Filed: Jul. 5, 1977

[30] Foreign Application Priority Data

Jul. 7, 1976 [DE] Fed. Rep. of Germany ..... 2630524

[51] Int. Cl.[2] ..... F24H 9/08

[52] U.S. Cl. ..... 165/55; 165/130

[58] Field of Search ..... 165/129–131, 165/53–55, 56

[56] References Cited

U.S. PATENT DOCUMENTS

| | | | |
|---|---|---|---|
| 1,861,484 | 6/1932 | Stevenson | 165/129 |
| 2,196,318 | 4/1940 | Maier | 165/130 |
| 2,212,201 | 8/1940 | Daly et al. | 165/129 X |
| 3,426,840 | 2/1969 | Markowz | 165/129 |

*Primary Examiner*—Samuel Scott
*Assistant Examiner*—Theopwil W. Streule, Jr.
*Attorney, Agent, or Firm*—Haseltine, Lake & Waters

[57] ABSTRACT

A warm water heater consists of a plurality of horizontally arranged profile elements spaced one above the other and attached to a pair of vertical posts, whereby between each pair of profile elements a horizontal air inlet gap is formed at the rearward side of the heater and a horizontal air outlet gap at the front side of the heater. The inlet gap is disposed at a lower level than the outlet gap. Each profile element is provided with an integral water channel, the ends of which communicating with vertical water channels provided in the vertical posts respectively. Plugs are inserted in the water channels in a predetermined pattern so that warm water is positively passed through the heater along a serpentine way.

9 Claims, 3 Drawing Figures

WARM WATER HEATER

Warm water heaters are known which consist of a plurality of vertical profile elements arranged side by side and being connected mechanically and on the water side with one another. These known heaters have a multiplicity of sealing places and require high costs for assembly. Further because of the chimney effect in the gap between each pair of the profile elements air flows with high velocities are present which inadvantageously carry over dust.

One object of the invention is the production of a new heater which is easier and can be produced with lower costs. A further object is the production of a heater having better air conditioning capabilities. The new heater should have a modern appearance.

The invention consists in that the warm water heater comprises a plurality of horizontally arranged profile elements spaced and aligned in vertical direction, the ends of all of the profile elements on the one side and on the opposite side of the heater are fastened at a pair of support posts respectively, each profile element consisting of one piece and having a constant cross-section is provided with a front wall, a rear wall and an intermediate wall connecting the lower edge of the front wall with the upper edge of the rear wall and is further provided with an integral water pipe arranged between the front and rear walls, the ends of the water pipes of the profile elements being connected with a pair of vertical water channels provided in the vertical posts respectively, at least one of the water channels having feeding and/or discharging openings.

The advantages of the invention consist in that a substantial reduced number of sealing places are necessary. Heaters with a large heat exchange surface differ from those having a low heat exchange surface only by the different longitudinal extensions but not by the number of the profile elements. The assembly is easy and can quickly be done by unskilled people. Between each two profile elements a horizontal inlet gap is formed in the vertical rearward plane of the heater and a horizontal outlet gap in the front plane of which. A plurality of air streams are obtained which instead of flowing vertically are passed from the rear side to the front side through the heater. Any undesired chimney effect is avoided. Because of wide inlet and outlet gaps lower air flow speeds are obtained. The production of the new warm water heater is remarkably easier and more inexpensive because the profile elements need not any machining or treatment. They can be lacquered or coated before assembling.

The drawing shows one example of the invention.

Figure 1:
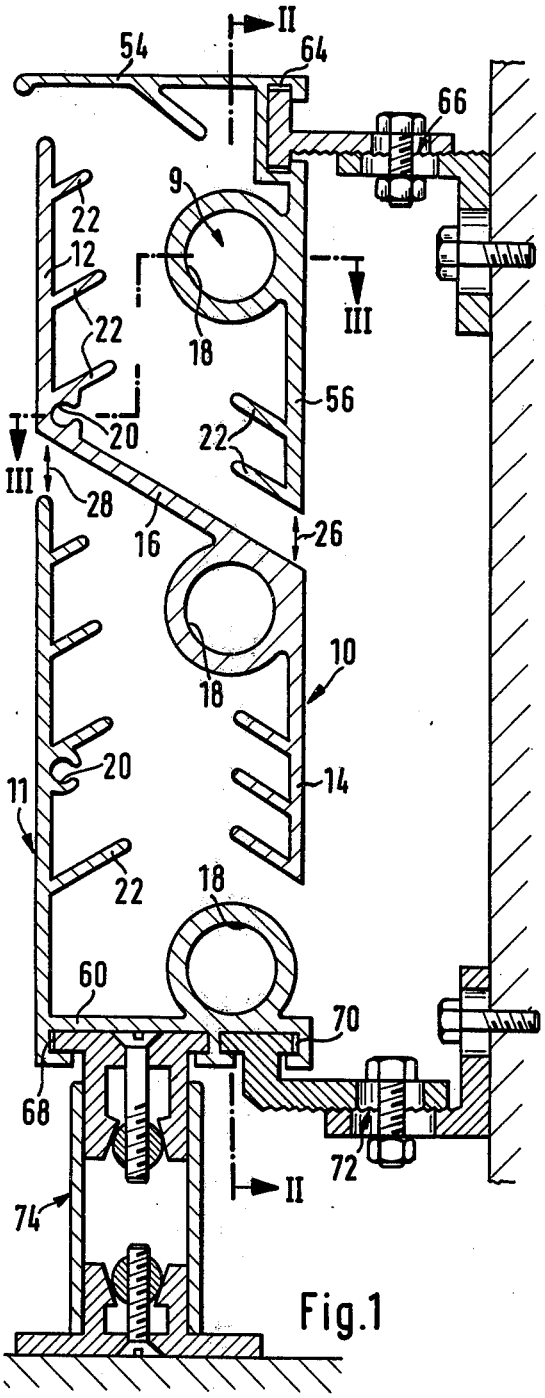
FIG. 1 shows a vertical sectional view of the heater taken along the line 1—1 of FIG. 2.
Figure 3:
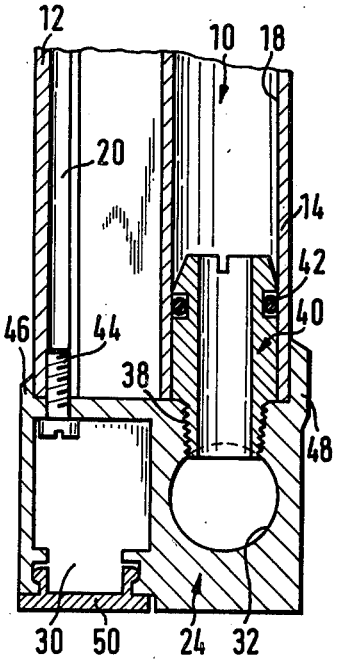
FIG. 3 shows a horizontal sectional view partly broken away and taken along the line 3—3 of FIG. 1.

The warm water heater consists of a plurality of horizontal profile elements 10 vertically spaced and arranged one above another. In FIG. 1 only one of the profile elements is shown. Each profile element 10 has a front wall 12, a rear wall 14 and an inclined intermediate wall 16 extending downwardly from the lower edge of the front wall to the upper edge of the rear wall. All front walls 12 lie in a vertical front plane and all rear walls 14 lie in a vertical rearward plane. At the inner corner between rear wall 14 and intermediate wall 16 a water pipe 18 is integrally formed extending over the whole length of the profile element 10. At the diametrally opposed corner between front wall 12 and intermediate wall 16 a channel 20 is formed. At the inner surfaces of the front wall 12 and rearward wall 14 ribs 22 are provided which extend obliquely upwards.

All profile elements 10 are supported at their ends in two vertical posts 24, so that horizontal air inlet gaps 26 are obtained between each pair of profile elements 10 in the vertical plane of the rear walls 14 and horizontal air outlet gaps 28 in the front wall plane. The profile elements 10 and the vertical posts 24 are extruded profiles and preferably consist of aluminium alloy. The profile elements 10 need not any machining or treatment except cutting the desired length.

The vertical post 24 has a fastening channel 30 in the front region and a rearward water channel 32 which is closed by plugs 36 at the upper and lower ends. From the inner lateral side of the posts 24 conical screw holes with predetermined distances extend into the water channel 32. Connection nipples 40 having conical screw threads 38 at one end are tightly screwed into the screw holes of the posts 24. At the other end the nipples 40 are of cylindrical shape and fit into the water pipes 18 of the profile elements 10 and are sealed by O-rings 42.

Figure 2:
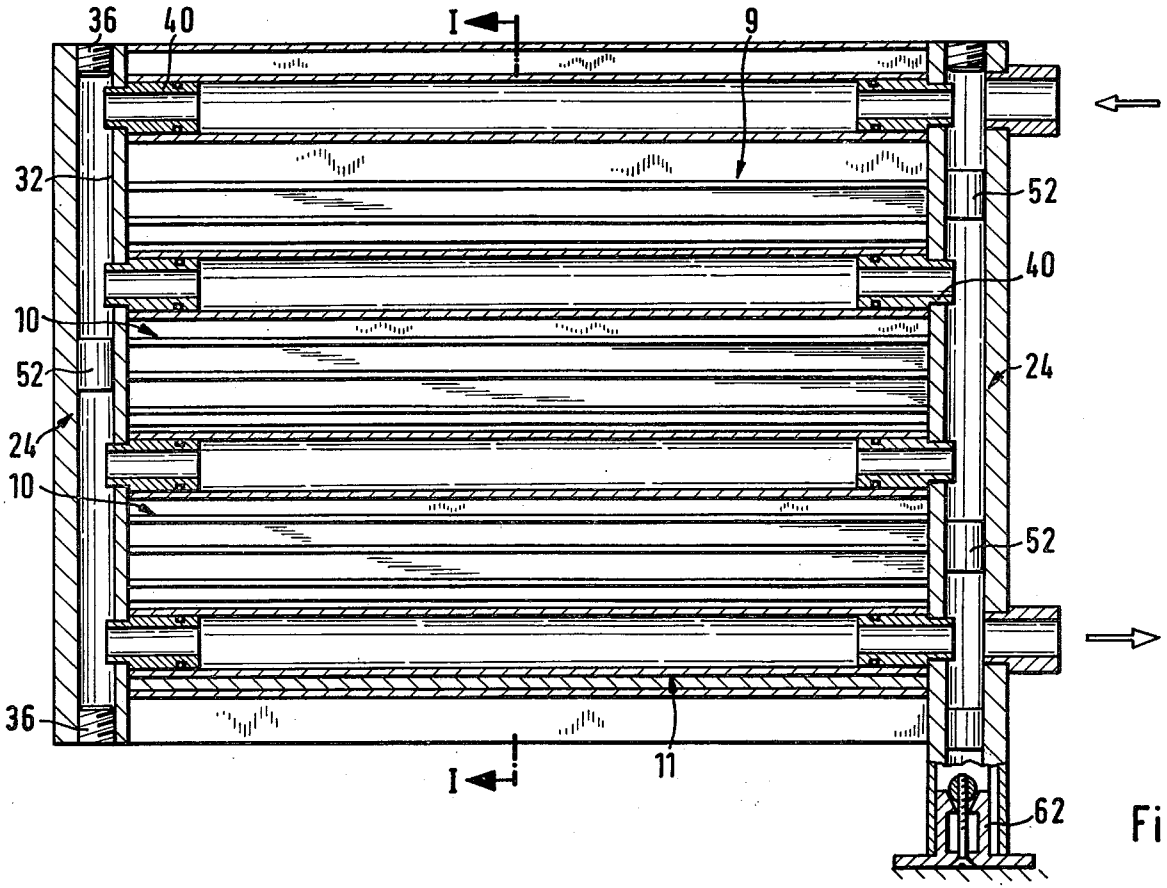
FIG. 2 shows a vertical sectional view of the heater substantially taken along the line 2—2 of FIG. 1, but with a greater number of profile elements of the heater

At the inner lateral side wall of the fastening channel 30 of each of the pair of posts 24 a row of spaced holes is provided through which are passed self-tapping fastening screws 44 which are screwed into the channels 20 of the profile elements. The post 24 has a front rib 46 and a rearward rib 48. Both ribs 46, 48 extend over the whole length of the post 24 and overlap the front and rear walls 12, 14 of the plurality of profile elements 10 respectively, whereby the inner width between the ribs 46, 48 is equal with the outer width of the front and rear walls 12, 14 of each of the profile elements. A blind strip 50 closes the fastening channel 30 after assembling the parts. By the construction of the nipple 40 having two portions, one of which is provided with a conical screw thread and the other is cylindrical and has a groove supporting an O-ring 42, an easy assembly is obtained. First the nipples are screwed into the holes of posts 24 after closing plugs 52 have been inserted into the water channel 32 between two nipples 40 at a predetermined pattern. Because the nipples 40 extend into the water channels 32 an undesired displacement of the nipples such that some water pipes of the profile elements become short-circuited is avoided. As seen from FIG. 2 in one post 24 behind the second, fourth, sixth, eighth, . . . nipple a plug is inserted respectively and in the opposite post behind the first, third, fifth, seventh, . . . nipple 40 a plug 52 is inserted respectively. So water passes the heater in a serpentine form alternately left to right and right to left.

After the nipples have been assembled at the posts and plugs have been inserted in the posts the profile elements 10 are connected with one of the posts, by pushing the water pipes 18 on to the nipples and screwing the fastening screws 44 into the channels 20. It will be evident that the disposition of the water pipe 18 and the channel 20 on the one hand corresponds with each disposition of the conical hole in the water channel 32 and the fastening channel 20 of the post 24 on the other hand. The latter dispositions have predetermined spacings determining the height of the inlet and outlet gaps 26, 28.

After assembling of the post 24 at one end of the plurality of profile elements 10 the prepared other post is pushed into the opposite ends of the profile elements and fastened by the fastening screws 44.

The upmost part of the plurality of profile elements 10 is formed by an upper end profile element 9 which consists of a horizontal upper wall 54, a vertical rear wall 56 and a water pipe 18. At the lower end of the plurality of profile elements 10 a lower end profile element 11 is mounted consisting of a vertical front wall 58, a horizontal bottom wall 60, a water pipe 18 and a fastening channel 20. Both of the end profile elements 9, 11 also are provided with inclined ribs 22, which are directed upwardly at an oblique angle to the front and rear walls 12, 14 and which advantageously influence the air flow and increase the heat exchange surface.

The heater can be raised simply by making the posts 14 longer than the assembly of the packet of the profile elements 9, 10, 11 so that the posts extend beyond the lower end profile element and form supporting legs. Supporting feet 62 are inserted into the fastening channel 30 of the posts and fastened by straddling dowels (FIG. 1). The upper end profile element 9 is provided with a longitudinal groove 64 at its rear wall. Supporting brackets 66 are displaceably received in the groove 64 and fastened at a room wall. Thereby the spacing between the room wall and the heater can be adjusted and thermal expansions are taken into account. Similarly the lower end profile element 11 has grooves 70 in which supporting brackets 72 are received at one end and fastened at the room wall with the opposite end. Further grooves 68 are provided at the bottom wall 60 of the lower end profil element 11 for fastening supporting legs 74, which however only alternatively are used with respect to the lower extensions of the posts 24.

I claim:

1. A warm water heater apparatus having a front member in a vertical plane; rear walls; a plurality of vertically spaced horizontal water pipes, said pipes having ends connected with support posts provided with water channels, wherein: said front and rear walls each being defined by a plurality of vertically spaced front wall portions (12) and vertically spaced rear wall portions (14), said rear wall portions (14) having a horizontal air inlet gap (26) formed therebetween and said front wall portions (12) having a horizontal air outlet gap (28) therebetween; one of said front wall portions, a rear wall portion, an intermediate wall (16) and an integral profile element (10) being provided with a constant cross-section, whereby said intermediate wall is disposed to connect the lower edge of the front wall portion (12) with the upper edge of the rear wall portion (14); and at least one water pipe (18) being integrally formed in said profile element (10).

2. A warm water heater apparatus as claimed in claim 1, wherein: a lower edge of front wall portion (12) in each of said profile elements (10) is at least as high as an upper edge of the rear wall portion (14) thereof.

3. A warm water heater apparatus as claimed in claim 1, wherein: inner surfaces of the front and rear wall portions (12, 14) are provided with upwardly inclined longitudinal ribs (22).

4. A warm water heater apparatus as claimed in claim 1, wherein: an upper end profile element (9) is provided which comprises a horizontal upper wall (54) and a vertical rear wall portion (56), the latter being flush with rear wall portions (14) of the plurality of profile elements (10).

5. A warm water heater apparatus as claimed in claim 1, wherein: lower end profile element (11) means is provided comprising a horizontal bottom wall (60) and a vertical front wall portion (58), the latter being flush with a plurality of front wall portions (12).

6. A warm water heater apparatus as claimed in claim 1, wherein: each profile element (10) is provided with a horizontally extending inner channel (20), having fastening screws affixed into the ends thereof, said screws are supported in the vertical posts (24).

7. A warm water heater apparatus as claimed in claim 6, wherein: said inner channel (20) is arranged at the front wall portion (12) and the water pipe (18) is arranged at the rear wall portion (14).

8. A warm water heater apparatus as claimed in claim 6, wherein: said vertical posts (24) have a constant cross-section over its whole length and is provided with a front rib (46) and a rear rib (48), the plurality of profile elements (10) being inserted between said pair of ribs (46, 48), the inner width between the ribs (46, 48) being equal to the distance between the outer surfaces of the front and rear wall portions (12, 14).

9. A warm water heater apparatus as claimed in claim 5, wherein: the end profile elements (9, 11) have longitudinally extending C-shaped outer channels (64, 68, 70) for engagement by wall or bottom supports (66, 72, 74).

* * * * *